US005609255A

United States Patent [19]

Nichols

[11] Patent Number: 5,609,255

[45] Date of Patent: Mar. 11, 1997

[54] WASHABLE SCRUBBING MOP HEAD AND KIT

[76] Inventor: Sally S. Nichols, 5815 Westover Dr., Knoxville, Tenn. 37919

[21] Appl. No.: 455,137

[22] Filed: May 31, 1995

[51] Int. Cl.[6] ..... B65D 69/00; A47L 13/20; A47L 13/24

[52] U.S. Cl. ..... 206/576; 15/144.3; 15/228; 15/229.11; 15/244.3; 206/362

[58] Field of Search ..... 206/576, 361, 206/362, 370; 15/228, 144.3, 229.11, 209.1, 244.3

[56] References Cited

U.S. PATENT DOCUMENTS

| | | | |
|---|---|---|---|
| 577,220 | 2/1897 | Whitehead . | |
| 789,258 | 5/1905 | Connolly . | |
| 1,027,209 | 5/1912 | Margolius . | |
| 1,665,988 | 4/1928 | Smith | 15/144.3 X |
| 2,107,636 | 2/1938 | Kingman | 15/229.11 X |
| 2,268,364 | 12/1941 | White et al. | 206/362 |
| 2,497,477 | 2/1950 | Stoops | 206/361 |
| 2,500,841 | 3/1950 | Fellman et al. | 15/228 X |
| 2,958,885 | 11/1960 | Donney | 15/244.3 X |
| 3,077,627 | 2/1963 | Ashworth . | |
| 3,596,304 | 8/1971 | Welt . | |
| 3,600,740 | 8/1971 | Ogier | 206/576 X |
| 4,000,537 | 1/1977 | Woo . | |
| 4,130,683 | 12/1978 | Michel et al. | 15/229.11 X |
| 4,530,130 | 7/1985 | Moss . | |
| 4,852,210 | 8/1989 | Krajicek . | |
| 4,945,599 | 8/1990 | Flynn | 15/244.3 |
| 5,042,105 | 8/1991 | Buck et al. . | |
| 5,319,821 | 6/1994 | Nicholson et al. . | |
| 5,333,347 | 8/1994 | Stranders . | |
| 5,343,587 | 9/1994 | Findley . | |
| 5,419,015 | 5/1995 | Garcia | 15/228 |

FOREIGN PATENT DOCUMENTS

| | | | |
|---|---|---|---|
| 3339603 | 5/1985 | Germany | 15/228 |
| 6708504 | 12/1968 | Netherlands | 15/228 |
| 2225222 | 5/1990 | United Kingdom | 15/228 |

*Primary Examiner*—Bryon P. Gehman
*Attorney, Agent, or Firm*—Pitts & Brittian, P.C.

[57] ABSTRACT

A washable scrubbing mop head and kit (10) for provided for cleaning floors and other surfaces using minimal amounts of water and cleaning fluids (50). The mop (10) of the present invention includes a mop handle (12), a mop head (20), a mop pad (28), and a storage device (40). The mop handle (12) includes a plurality of sections (14) securable one to another in an end-to-end fashion. The mop head (20) is comprised of a flat plate (22) having a threaded receptor (24) secured thereto for receiving a threaded extension (16) defined by a section (14) of the mop handle (12). A securement device (26) is secured to the mop head plate (22) for the securement of a mop pad (28) thereto. A mop pad (28) is releasably secured to the mop head (20) such that it may be removed for cleaning thereof. The mop pad (28) is comprised of a base member (30), a filler material (32), a fabric covering (34), and a netting (36). The base member (30) is fabricated from a material which is at least semi-rigid such as plastic. Above the base member (30) is disposed a filler material (32) such as fiberfill batting and is provided for absorbing liquids. The fabric covering (34) is fabricated from a conventional cotton knit fabric. The netting (36) is fabricated from a synthetic material and is provided for improving scrubbing action. A storage device (40) is provided for storing and transporting the mop. The storage device (40) includes a panel (41) to which is secured a plurality of pouches (42) individually configured to carry at least the sections (14) of the mop handle (12), the mop head (20), and at least one mop pad (28).

12 Claims, 3 Drawing Sheets

WASHABLE SCRUBBING MOP HEAD AND KIT

TECHNICAL FIELD

This invention relates to the field of cleaning supplies. More specifically, this invention relates to a washable scrubbing mop head and a kit for the application thereof.

BACKGROUND ART

In the field of cleaning it is well known that cleaning floors is often difficult to accomplish while conserving water and detergents, while also insuring that the subject floor adequately cleaned. Typically, floors are mopped using various types of conventional mop heads, the mop head being immersed in a volume of water and soap. Several gallons of water and a proportional amount of detergent are used to clean the floor. After the mop is immersed into the water and detergent, a portion of the liquid is squeezed from the mop head and the mop is then wiped across the floor to be cleaned. This leaves the floor wet for a period of time. After the mop head becomes soiled, or after the cleaning fluids have been used up, the mop head is rinsed in the volume of water and detergent, and the process is repeated. After several iterations, the volume of liquid becomes noticeably soiled. Therefore, further applications of the liquid on the floor essentially results in further soiling the floor. Essentially, using conventional methods such as that described, dirt remains on the floor after mopping. Further, dirt remains in the mop head even after thorough rinsing. Taken as a whole, it is well known that conventional mopping methods require several gallons of water. Further, rinsing or washing conventional mop heads also requires several gallons of water to adequately clean the same.

Another problem often associated with mopping floors is that of storage of the mop. Conventionally, mop handles vary in length from approximately four feet to approximately five feet. A conventional mop head is typically secured to the distal end of the mop handle. In mops not having a mop head secured to the mop handle, a mop head base is secured thereto, with the mop head typically being a replaceable sponge-type mop head.

Many devices have been produced to overcome deficiencies in the art as described. Typical of the art are those devices disclosed in the following U.S. Patents:

| U.S. Pat. No. | Inventor(s) | Issue Date |
|---|---|---|
| 577,220 | T. P. Whitehead | Feb. 16, 1897 |
| 789,258 | M. T. Connolly | May 9, 1905 |
| 1,027,209 | D. Margolius | May 21, 1912 |
| 3,077,627 | B. A. Ashworth | Feb. 19, 1963 |
| 3,596,304 | D. I. Welt | Aug. 3, 1971 |
| 4,000,537 | Y. K. Woo | Jan. 4, 1977 |
| 4,530,130 | T. C. Moss | July 23, 1985 |
| 4,852,210 | S. W. Krajicek | Aug. 1, 1989 |
| 5,042,105 | M. J. Buck, et al. | Aug. 27, 1991 |
| 5,319,821 | R. V. Nicholson, et al. | June 14, 1994 |
| 5,333,347 | R. Stranders | Aug. 2, 1994 |
| 5,343,587 | M. L. Findley | Sept. 6, 1994 |

Of these devices, those devices disclosed by Whitehead ('220), Connolly ('258), Margolius ('209), and Findley ('587) each incorporate various methods of sectioning the mop handle in order to vary the length. The length may be varied for reaching difficult locations, for use by persons of varying heights, or for ease of storage. However, these devices are not disclosed as having removable, washable mop heads. Further, these devices are not associated with mop heads which require minimal amounts of water and cleaning fluids.

Those patents issued to Ashworth ('627), Welt ('304), Woo ('537), Moss ('130), and Nicholson, et al. ('821) each disclose a tool having a removable handle. However, neither of these devices teaches the use of a water-conserving mop head.

Buck, et al. ('105) teach a removable mop head cover fabricated from terry cloth for cleaning the depressions in vinyl flooring. The mop head cover is specifically disclosed as being provided for covering a sponge-type mop head. However, the mop head is otherwise used in conventional fashion. Specifically, the mop head cover of the '105 device is used with a bucket of water and cleaning agents as described above.

Stranders ('347) discloses a device for cleaning the inner surfaces of the windshields of an automobile. The '347 device is specifically designed to overcome the difficulties of cleaning these surfaces due to the concave configuration of each and the obstacles presented, such as the dashboard and steering wheel, when attempting to clean the same. While disclosing such a device, Stranders also discloses a removable cleaning cloth secured to the mop head in one embodiment using conventional hook-and-loop fasteners. This device still fails to teach a cleaning pad construction wherein minimal cleaning fluids are required.

Krajicek ('210) discloses a wet mop for use with an interchangeable scrubbing pad and cloth wipe. The cloth wipe is fabricated from terry cloth and is provided with an elastic band around its perimeter for securing the cloth to the mop head. The scrubbing pad is held in place using conventional hook-and-loop fasteners. However, the mop disclosed by Krajicek is described as being a wet mop, such as the conventional mops set out above.

None of the prior an made of record has disclosed a mop wherein a mop head is used which requires minimal cleaning fluids in order to sanitarily clean a floor. Further, the prior art fails to disclose a construction of a mop head which may be reused after washing in a conventional clothes washing machine along with other clothing, thus requiring no additional water or cleaning agents to clean the mop.

Therefore, it is an object of this invention to provide a mop having a removable mop head whereby minimal cleaning fluids are required to sanitarily clean a floor.

Another object of the present invention is to provide such a mop wherein the mop head is provided with a removable pad which is washable in a conventional washing machine and thus reusable.

A further object of the present invention is to provide such a mop head whereby repeated use of the mop head pad minimizes waste due to the disposal of used mops and mop heads as in conventional devices.

Still another object of the present invention is to provide a mop having a mop handle removable from the mop head and sectioned such that the handle may be broken down into at least two portions for easy storage and transport of the mop.

DISCLOSURE OF THE INVENTION

Other objects and advantages will be accomplished by the present invention which is provided for cleaning floors and other surfaces using minimal amounts of water and cleaning fluids. Moreover, in the preferred embodiment the washable scrubbing mop head and kit is designed such that the mopping pad may be reused after washing in a conventional washing machine along with other laundry such as white clothes, thus not requiring additional water and detergent to be spent in order to clean the pad.

The mop of the present invention is comprised generally of a mop handle, a mop head, a mop pad, and a storage device. The mop handle includes a plurality of sections securable one to another in an end-to-end fashion. The mop head is comprised of a flat plate having a threaded receptor secured thereto for receiving a threaded extension defined by either the end section or an extension section of the mop handle. A securement device is secured to the bottom side of the mop head plate for the securement of a pad thereto. A mop pad is releasably secured to the mop head such that it may be removed for cleaning thereof. The mop pad carries a fastener to cooperate with the mop head fastener. The mop pad is comprised of a base member, a filler material, a fabric covering, and a netting. The base member is fabricated from a material which is at least semi-rigid such as plastic. Above the base member is disposed a filler material such as fiberfill batting and is provided for absorbing liquids. The fabric covering is fabricated from a conventional cotton knit fabric. The netting is fabricated from a synthetic material and is provided for improving scrubbing action.

A storage device is provided for storing and transporting the mop of the present invention. The storage device is generally composed of a piece of fabric to which is secured a plurality of pouches individually configured to carry at least the sections of the mop handle, the mop head, and at least one mop pad. Another pouch may be provided for receiving a spray bottle for storing cleaning fluids for use in conjunction with the mop. When the individual components of the present invention are received within the individual pouches, the device may be rolled up and secured using a securement device such as a string. When so secured, the storage device and mop may be stored in a drawer, or may be easily transported. Otherwise, at least two hanging devices are provided for hanging the storage device in an open position on a wall or closet door.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

A washable scrubbing mop head and kit incorporating various features of the present invention is illustrated generally at 10 in the figures. The washable scrubbing mop head and kit, or mop 10, is designed for cleaning floors and other surfaces using minimal amounts of water and cleaning fluids. Moreover, in the preferred embodiment the washable scrubbing mop head and kit 10 is designed such that the mop pad 28 may be reused after washing in a conventional washing machine along with other laundry such as white clothes, thus not requiring additional water and detergent to be spent in order to clean the pad 28.

Figure 1:
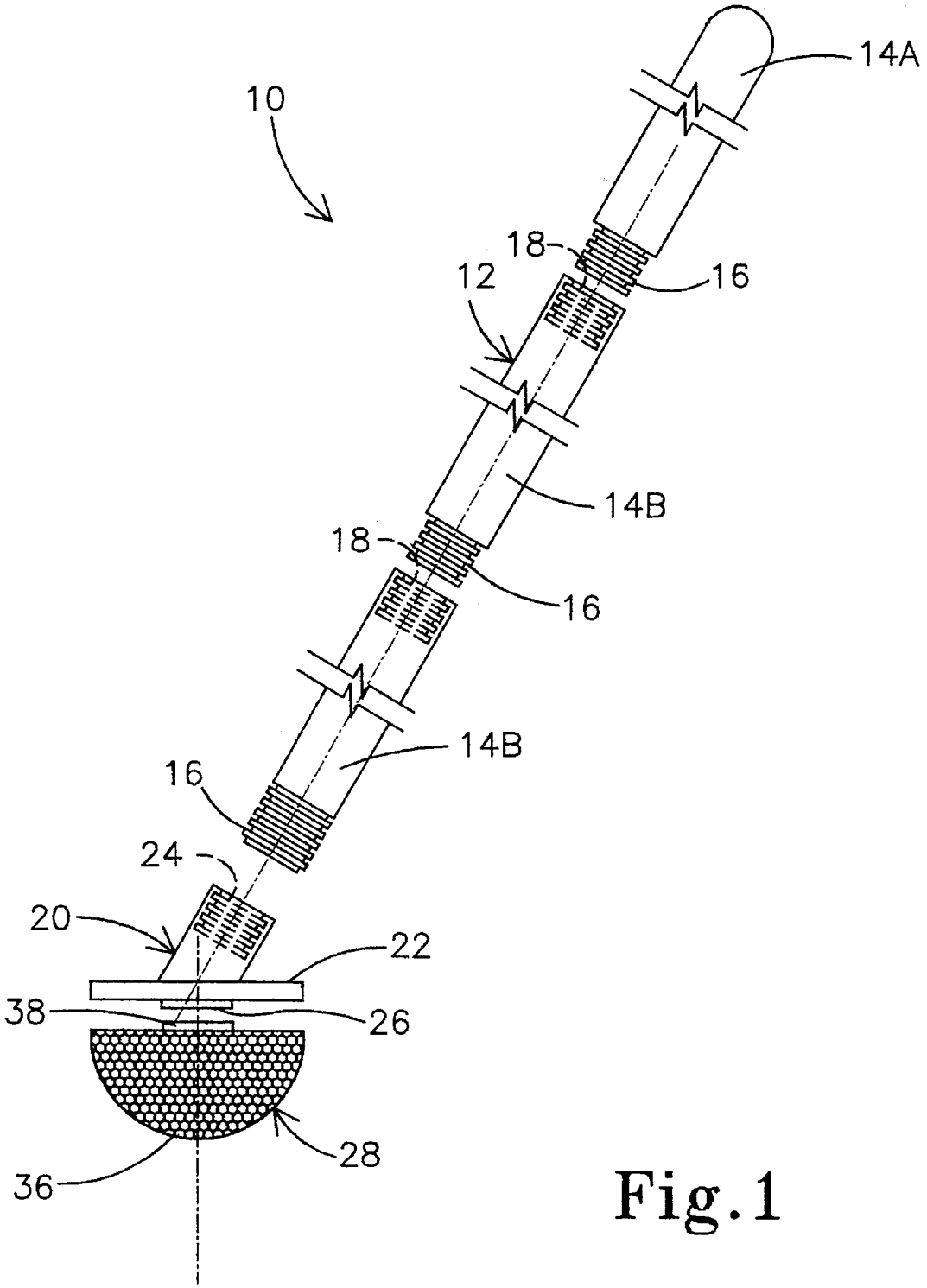
FIG. 1 is a side elevational view of the washable scrubbing mop head constructed in accordance with several features of the present invention shown in association with a sectioned mop handle.

The mop 10 of the present invention is comprised generally of a mop handle 12, a mop head 20, a mop pad 28, and a storage device 40. The mop handle 12, as illustrated in FIG. 1 includes a plurality of sections 14 securable one to another in an end-to-end fashion. An end section 14A defines a rounded end at one end and a threaded extension 16 at the other. Extension sections 14B define a threaded receptor 18 at one end and a threaded extension 16 at the other. The threaded extensions 16 of the end section 14A and the extension sections 14B are configured to cooperate with, and thus be received within, the threaded receptors 18 defined by the extension sections 14B. Of course, other conventional methods may be used as well to secure the sections 14 to each other.

The mop head 20 is comprised of a flat plate 22 having a threaded receptor 24 secured thereto for receiving a threaded extension 16 defined by either the end section 14A or an extension section 14B of the mop handle 12. The threaded receptor 24 is carried by the mop head 20 at a central location on the top surface of the mop head plate 22. A securement device 26 is secured to the bottom side of the mop head plate 22 for the securement of a pad 28 thereto. As illustrated, the preferred securement device 26 is a hook-and-loop fastener, with the loop portion thereof being secured to the mop head plate 22. However, other conventional fasteners may be used as well.

Figure 3:
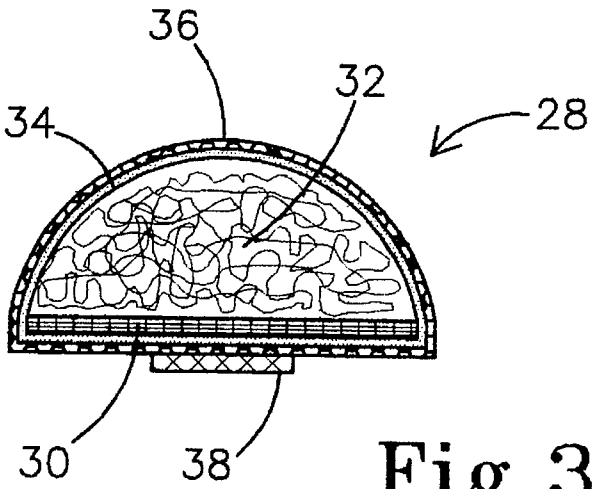
FIG. 3 is an end view, in section taken along 3—3 of FIG. 2, illustrating the construction of the pad member of the present invention.
Figure 2:
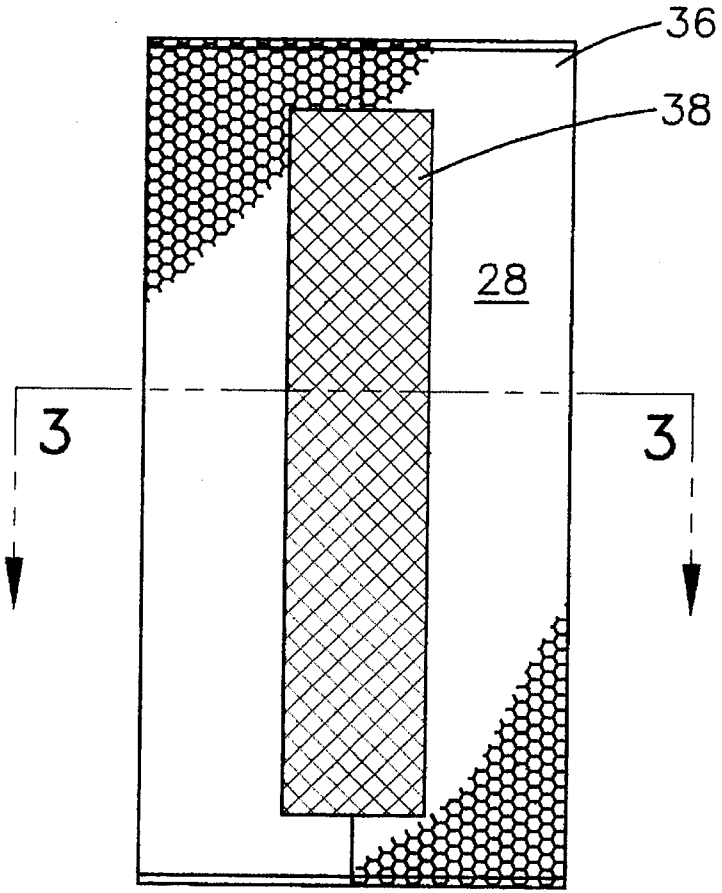
FIG. 2 illustrates a top plan view of a pad member of the washable scrubbing mop head.
Figure 4:
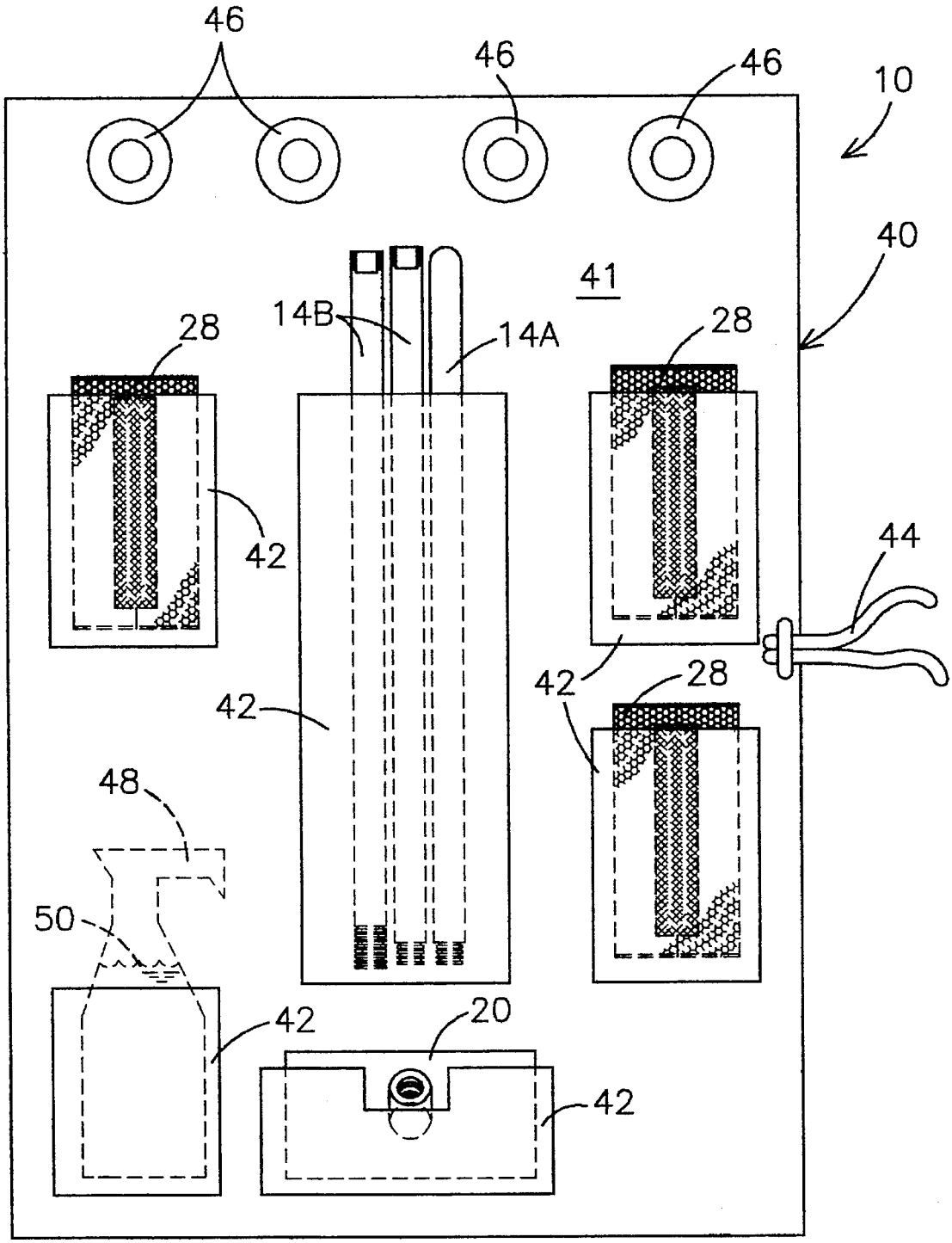
FIG. 4 illustrates a plan view of a storage device provided for storing at least the sectioned mop handle and the mop head of the present invention.

A mop pad 28, more clearly illustrated in FIGS. 2 and 3, is releasably secured to the mop head 28 such that it may be removed for cleaning thereof The mop pad 28 carries a securement device 38 to cooperate with the mop head securement device 26. As illustrated, the preferred securement device 38 is a hook portion of a hook-and-loop fastener. As illustrated in FIG. 3, the mop pad 28 is comprised of a base member 30, a filler material 32, a fabric covering 34, and a netting 36. The base member 30 is fabricated from a material which is at least semi-rigid. The base member 30 of the preferred embodiment is fabricated from a semi-rigid plastic. Above the base member 30 is disposed a filler material 32 such as fiberfill batting and is provided for absorbing liquids. The fabric covering 34 of the preferred embodiment is fabricated from a conventional cotton knit fabric. The netting 36 is fabricated from a synthetic material and is provided for improving scrubbing action.

The mop pad 28 of the present invention is fabricated by overlaying the fabric covering 34 and the netting 36 and stitching two opposing sides in order to form a tube, with the netting 36 being disposed on the outer surface thereof. One end is then stitched to close that end. The base member 30 and the filler material 32 are placed within the fabric covering and the opened end is stitched closed. Finally, the securement device 38 is secured to the mop pad 28 on the side proximate the base member 30.

The mop 10 of the present invention is used to clean floors and other surfaces. Due to the construction of mop pad 28, a minimal amount of cleaning fluid 50 is required for such cleaning. For purposes of the present application, cleaning fluid 50 is defined as a solution of water and cleaning agents as required by the specific use. For most efficient use, the cleaning fluid 50 is placed within a spray bottle 48 whereby controlled amounts of cleaning fluid 50 may be applied to the mop pad 28 or to the surface to be cleaned as required. As a floor or other surface is being cleaned, soiled fluids are stored within the filler material 32. However, because controlled amounts of cleaning fluids 50 are applied to the mop pad 28 or to the surface being cleaned, the mop pad 28 does not become saturated quickly. When cleaning spills, the mop pad 28 may be removed and wrung out in order to remove excess liquid. When a mop pad 28 becomes too soiled for cleaning a floor, the mop pad 28 may be replaced with another mop pad 28. After cleaning the desired floors, dirty mop pads 28 are washed in a conventional washing machine with other laundry such as towels or white clothing and then reused. If desired, the mop pad 28 of the present invention may be bleached.

It has been found that by spraying a small amount of cleaning fluid 50 on the mop pad 28, a comparable area may be cleaned when compared to the area cleaned using conventional mop-and-bucket methods. Further, it has also been found that floors cleaned in the manner described leave floors at least as clean, and often cleaner, than floors cleaned using conventional methods. Because the mop pads 28 of the present invention are washable with other laundry, it will be seen that no additional water or detergent is required to clean the mop pads 28. Specifically, because room is often available in a load of laundry for the mop pads 28 of the present invention, additional washing is not required. It has been found that the construction of the mop pad 28 of the present invention as described is durable to withstand many uses and washings.

Obvious benefits are a result of the conservation of water in the cleaning of floors. Other benefits from the use of the present invention include a reduced amount of detergents wasted and disposed of in the environment. This wasted water and detergent is associated both with the use of conventional mops and the cleaning of conventional mop heads. Further, the reusable mop pad 28 reduces the amount of waste generated from spent conventional mop heads and mops.

In order to store and transport the mop 10 of the present invention, a storage device 40 is provided. The storage device 40 of the present invention is generally composed of a panel 41 to which is secured a plurality of pouches 42. The pouches 42 are individually configured to carry at least the sections 14 of the mop handle 12, the mop head 20, and at least one mop pad 28. More than one mop pad 28 may be carried within a pouch 42. Further, a pouch 42 dimensioned to receive the mop handle sections 14 may be provided with dividers (not shown) to separate the individual sections 14 one from another. Another pouch 42 may be provided for receiving a spray bottle 48 for storing cleaning fluids 50 for use in conjunction with the mop 10. When the individual components of the present invention are received within the individual pouches 42, the device 40 may be rolled up and secured using a securement device 44 such as the illustrated string. When so secured, the storage device 40 and mop 10 may be stored in a drawer, or may be easily transported. Otherwise, a plurality of hanging devices 46 is provided for hanging the storage device 40 in an open position on a wall or closet door. As illustrated, the hanging devices of the present invention are grommets secured to the panel 41, each grommet being provided for receiving a nail, hook, or other conventional device.

From the foregoing description, it will be recognized by those skilled in the art that a washable scrubbing mop head and kit offering advantages over the prior art has been provided. Specifically, the washable scrubbing mop head and kit provides a means for cleaning floors using minimal cleaning fluids and while providing a mop pad which may be cleaned using no additional water or cleaning powders over current requirements of the user. By providing such a device, many environmental concerns are alleviated, and specifically, less water is consumed and less waste is produced when compared to conventional floor cleaning methods. While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, I claim:

1. A mop pad comprising:

a base member fabricated from an at least semi-rigid material, said base member defining a planar configuration a having a first side and a second side;

a covering member enclosing said base member and defining a discrete volume within and on said first side of said base member;

a netting material carded by said covering member for enhancing scrubbing action of said mop pad;

a filler material received within said discrete volume defined by said covering member, said filler material for absorbing fluids; and a securement device carried by said netting material proximate said second side of said base member, said securement device cooperating with a securement device carried by a mop head to which said mop pad is releasably secured, said mop pad being washable in a conventional washing machine and dryable in a conventional clothes dryer such that said mop pad is reusable, said mop pad requiring minimal water and cleaning agents for cleaning surfaces and for cleaning said mop pad, said mop pad producing minimal waste as a result of degradation thereof.

2. The mop pad of claim 1 wherein said base member is fabricated from a semi-rigid plastic.

3. The mop pad of claim 1 wherein said covering member is fabricated from a cotton knit fabric.

4. The mop pad of claim 1 wherein said netting material is fabricated from a synthetic material.

5. The mop pad of claim 1 wherein said filler material is fabricated from a fiberfill batting.

6. The mop pad of claim 1 wherein said mop head is releasably secured to a mop handle, said mop handle including a plurality of sections releasably secured one to another in an end-to-end fashion.

7. The mop pad of claim 6 wherein a storage device is provided for storage and transport of at least one said mop pad, said mop head, :and said mop handle, said storage device including a panel member to which is secured a plurality of pouches, said plurality of pouches being individually configured to closely receive one said mop pad, said mop head, and said mop handle.

8. The mop pad of claim 7 wherein said storage device is further provided for storing and transporting a cleaning fluid container, the cleaning fluid container being of a conventional type for storing and dispensing liquid, one of said plurality of pouches being configured to closely receive the cleaning fluid container.

9. A mop kit comprising:

a mop pad, said mop pad comprising a base member fabricated from a semi-rigid plastic, said base member defining a planar configuration having a first side and a second side;

a covering member enclosing said base member and defining a discrete volume within and on first side of said base member, said covering member fabricated from a cotton knit fabric;

a netting material carried by said coveting member for enhancing scrubbing action of said mop pad, said netting material being fabricated from a synthetic material;

a filler material received within said discrete volume defined by said covering member, said filler material for absorbing fluids, said filler material being fabricated from a fiberfill batting; and a first securement device carried by said netting material proximate said second side of said base member, said mop pad being washable in a conventional washing machine and dryable in a conventional clothes dryer such that said mop pad is reusable, said mop pad requiting minimal water and cleaning agents for cleaning surfaces and for cleaning said mop pad, said mop pad producing minimal waste as a result of degradation thereof; said kit further comprising a mop head releasably secured to a mop handle, said mop head including a plate member, a mop handle receptor, and a second securement device, said second securement device cooperating with said first securement device carded by said mop pad to releasably secure said mop pad to said mop head; and a storage device for storing and transporting at least one said mop pad, said mop head, and said mop handle, said storage device including a panel member to which is secured a plurality of pouches, said plurality of pouches being individually configured to closely receive one said mop pad, said mop head, and said mop handle.

10. The mop kit of claim 9 wherein said mop head is releasably secured to said mop handle, said mop handle including a plurality of sections releasably secured one to another in an end-to-end fashion.

11. The mop kit of claim 9 wherein said storage device is further provided for storing and transporting a cleaning fluid container, the cleaning fluid container being of a conventional type for storing and dispensing liquid, one of said plurality of pouches being configured to closely receive the cleaning fluid container.

12. A mop kit comprising:

a mop pad, said mop pad comprising a base member fabricated from an at least semi-rigid material, said base member defining a planar configuration having a first side and a second side;

a covering member enclosing said base member and defining a discrete volume within and on said first side of said base member;

a netting material carried by said covering member for enhancing scrubbing action of said mop pad;

a filler material received within said discrete volume defined by said covering member, said filler material for absorbing fluids; and a first securement device carded by said netting material proximate said second side of said base member, said mop pad being washable in a conventional washing machine and dryable in a conventional clothes dryer such that said mop pad is reusable, said mop pad requiring minimal water and cleaning agents for cleaning surfaces and for cleaning said mop pad, said mop pad producing minimal waste as a result of degradation thereof, said kit further comprising a mop handle including a plurality of sections releasably secured one to another in an end-to-end fashion;

a mop head releasably secured to said mop handle, said mop head including a plate member, a mop handle receptor, and a second securement device, said second securement device cooperating with said first securement device carried by said mop pad to releasably secure said mop pad to said mop head; and a storage device for storing and transporting at least one said mop pad, said mop head, said mop handle, and a cleaning fluid container, the cleaning fluid container being of a conventional type for storing and dispensing liquid, said storage device including a panel member to which is secured a plurality of pouches, said plurality of pouches being individually configured to closely receive one said mop pad, said mop head, said mop handle, and the cleaning fluid container.

* * * * *